US010161064B2

(12) United States Patent
Nishitani et al.

(10) Patent No.: US 10,161,064 B2
(45) Date of Patent: Dec. 25, 2018

(54) FIBER FOR WETLAID NON-WOVEN FABRIC

(75) Inventors: Takayuki Nishitani, Osaka (JP); Masuo Iwata, Osaka (JP)

(73) Assignees: ES FiberVisions Co., Ltd., Osaka-shi, Osaka (JP); ES FiberVisions Hong Kong Limited, Kowloon (HK); ES FiberVisions LP, Athens, GA (US); ES FiberVisions ApS, Varde (DK)

( * ) Notice: Subject to any disclaimer, the term of this patent is extended or adjusted under 35 U.S.C. 154(b) by 116 days.

(21) Appl. No.: 12/524,262

(22) PCT Filed: Feb. 13, 2008

(86) PCT No.: PCT/JP2008/052793

§ 371 (c)(1),
(2), (4) Date: Jul. 23, 2009

(87) PCT Pub. No.: WO2008/099960

PCT Pub. Date: Aug. 21, 2008

(65) Prior Publication Data

US 2009/0324947 A1 Dec. 31, 2009

(30) Foreign Application Priority Data

Feb. 13, 2007 (JP) ..... 2007-032313

(51) Int. Cl.
*D01F 8/06* (2006.01)
*D21H 15/04* (2006.01)
*D21H 13/14* (2006.01)

(52) U.S. Cl.
CPC ..... *D01F 8/06* (2013.01); *D21H 15/04* (2013.01); *D21H 13/14* (2013.01); *Y10T 428/2922* (2015.01); *Y10T 428/2924* (2015.01)

(58) Field of Classification Search
CPC ..... Y10T 428/2924; Y10T 428/2922; Y10T 428/29; Y10T 428/2913; Y10T 428/2931;
(Continued)

(56) References Cited

U.S. PATENT DOCUMENTS 3,900,678 A * 8/1975 Aishima et al. ..... 428/374
4,500,384 A 2/1985 Tomioka et al.
(Continued)

FOREIGN PATENT DOCUMENTS

EP 0086103 8/1983
EP 685579 B1 * 12/1998
(Continued)

OTHER PUBLICATIONS

Complete Textile Glossary. Celanese Acetate LLC. 2001. pp. 5-6.*
(Continued)

*Primary Examiner* — Humera N Sheikh
*Assistant Examiner* — Elaine M Vazquez
(74) *Attorney, Agent, or Firm* — Hamre, Schumann, Mueller & Larson, P.C.

(57) ABSTRACT

There is provided a fiber for a wetlaid non-woven fabric, said fiber can be the basis ingredient of a paper that maintains uniform mass per unit area and fiber dispersion and has unprecedented bulkiness. The fiber for a wetlaid non-woven fabric has 30 to 100 wt % of apparently crimping fibers with a fiber diameter of from 3 to 40 μm and 0 to 70 wt % of latently crimping fibers with a fiber diameter of from 3 to 40 μm.

6 Claims, 1 Drawing Sheet

(58) Field of Classification Search
CPC ..... Y10T 442/611; Y10T 442/637; Y10T 442/681; Y10T 442/635; Y10T 442/638; B32B 19/00; D01F 8/06; D01F 8/14; D21H 15/04; D21H 13/14; D02G 1/18; D02G 3/02; D04H 13/005; D04H 3/102; D04H 13/00; D04H 3/08; D04H 3/10; D04H 1/42; D04H 3/16; D04H 1/46; D04H 1/48; D01E 8/00; D01E 8/06
USPC ..... 442/327–414; 428/198, 357, 370, 224, 428/296, 369, 374, 364, 373, 632, 362; 264/172.14, 172.15, 168, 119, 123–126
See application file for complete search history.

(56) References Cited

U.S. PATENT DOCUMENTS

| | | | | |
|---|---|---|---|---|
| 4,891,262 | A * | 1/1990 | Nakamae et al. | 442/334 |
| 5,102,724 | A * | 4/1992 | Okawahara et al. | 442/199 |
| 5,108,820 | A * | 4/1992 | Kaneko et al. | 428/198 |
| 5,522,810 | A * | 6/1996 | Allen et al. | 604/366 |
| 5,597,645 | A * | 1/1997 | Pike | B01D 39/1623 210/243 |
| 6,274,237 | B1 * | 8/2001 | Nakajima et al. | 428/370 |
| 8,093,161 | B2 | 1/2012 | Bansal et al. | |
| 2003/0171052 | A1 | 9/2003 | Bansal et al. | |
| 2004/0010894 | A1 * | 1/2004 | Goldwasser et al. | 28/104 |
| 2004/0234757 | A1 * | 11/2004 | Goda | 428/357 |
| 2005/0148266 | A1 * | 7/2005 | Myers et al. | 442/401 |

FOREIGN PATENT DOCUMENTS

| | | |
|---|---|---|
| JP | 62-268900 | 11/1987 |
| JP | 04-153349 | 5/1992 |
| JP | 06-302313 | 10/1994 |
| JP | 09-067786 | 3/1997 |
| JP | 09-239903 | 9/1997 |
| JP | 09-273096 | 10/1997 |
| JP | 11-131346 | 5/1999 |
| JP | 11-291377 | 10/1999 |
| JP | 3046347 | 3/2000 |
| JP | 2000-328367 | 11/2000 |
| JP | 2001-032139 | 2/2001 |
| JP | 2001-40531 | 2/2001 |
| JP | 2003-171825 | 6/2003 |
| JP | 2005-504183 | 2/2005 |
| JP | 2005-082939 | 3/2005 |
| JP | 2005-330612 | 12/2005 |
| JP | 2007-039821 | 2/2007 |
| KR | 88-000386 | 3/1988 |
| WO | WO 0116417 A1 * | 3/2001 |
| WO | 2007/001072 | 1/2007 |

OTHER PUBLICATIONS

What is a Staple Fiber? Online Textile Glossary. http://www.TextileGlossary.com. 2013.*
INEOS, Olefins & Polymers USA, Typical Engineering Properties of Polypropylene, copyright Feb. 2010, pp. 1-2.*
Plastic Material Data Sheets, Table: Typical Properties of Polypropylene, 2004; 2010 MatWeb, LLC.*
International Search Report of PCT/JP2008/052793, dated May 13, 2008.
Written Opinion of the International Searching Authority of PCT/JP2008/052793, dated May 13, 2008.
Office Action dated Jun. 10, 2010 in the corresponding Chinese patent application and English translation (11 pages total).

* cited by examiner

FIBER FOR WETLAID NON-WOVEN FABRIC

TECHNICAL FIELD

The present invention relates to a fiber that is suitable for obtaining a bulky paper. The paper is called "wetlaid non-woven fabric" herein. Specifically, the present invention relates to a fiber that is suitable for obtaining a bulky wetlaid non-woven fabric. More specifically, the present invention relates to a fiber for wetlaid non-woven fabric that is capable of maintaining the bulkiness thereof by fusing fibers together by a heat treatment process.

BACKGROUND ART

A dry processing method, such as a carding method or an airlaid method, is generally used to obtain a bulky non-woven fabric. Although the dry method allows to easily obtain a bulky non-woven fabric by providing crimps of various shapes, significant dispersion irregularity occurs in the mass per unit area and fibers, thus it is difficult to use the dry processing method for the purpose of obtaining a high uniformity. When applied to, for example, a battery separator, significant dispersion irregularity of the mass per unit area or fibers of a non-woven fabric to be used causes a short circuit and leakage of the electrolyte solution. In application of a high-efficiency filter, irregularity in a flow rate in a thin section may be caused, and in application of a cataplasm material, leakage of the chemical and the like may be caused.

Moreover, it is known that although a synthetic fiber such as a conjugate fiber can produce high non-woven fabric strength by forming a bulky web thereof into a non-woven fabric through heat processing, flattening of the fiber component is caused by heat-melting it, and the degree of freedom is controlled by adhering the fiber component with other fiber, reducing bulkiness.

On the other hand, a wet paper-making method developed out of an ancient paper pressing technology, and not only natural fibers such as pulp but also synthetic fibers or synthetic pulp are currently used in relatively large numbers since they can be supplied suitably at low cost. The wet paper-making method evenly disperses these fibrous matters in water and then cards the fibrous matter to thereby produce various characteristics, whereby a paper having high uniformity in the mass per unit area and thickness (a non-woven fabric obtained through a wet paper-making method) is obtained. The wet paper-making method is applied to a wide range or areas, such as sliding-screen papers, moist towelettes and the like for general purposes, and, for high-function purposes, a high-efficiency filter required to have a uniform film-thickness and a battery separator required to have high liquid-retaining ability associated with film thickness.

Most of the fibrous matters of a paper include functional synthetic fibers in order to provide the strength of the paper or a value-added characteristic. In order to have improved dispersibility in water, straight short fibers are often used as the synthetic fibers so that the fibers are dispersed easily without entangling with each other. As a result, thus obtained paper is in the form of thin paper reflecting low bulkiness of the straight fibers. Therefore, the wet paper-making method is considered unsuitable as a process for obtaining a bulky non-woven fabric.

In order to solve such problems, for example, in Japanese Patent Application Publication (hereunder referred to as "JP KOKAI") No. Sho 62-268900, there is proposed a method of blending highly stiff inorganic fibers, especially glass fibers, in order to improve liquid-retaining ability of a paper used in a batter separator. This secures a gap for retaining liquid, because it has a constant bulkiness and rigidity while forming a dense matrix by means of fine glass fibers. Also, for example, in JP KOKAI No. 2001-32139, there is proposed a method of producing a non-woven fabric using only latently crimping fibers, wherein three-dimensional crimping is produced in synthetic fibers by thermally shrinking them to provide bulkiness. However, the method using glass fibers is not exactly a suitable method because, although it can obtain bulkiness, extremely high cost is incurred and glass fiber is a material imposing an environmental load because it cannot be disposed or incinerated easily. Furthermore, the method using only latently crimping fibers is not exactly a suitable method due to its operational performance in which the production dimension is unstable and mass per unit area irregularity occurs easily, since bulkiness is produced by contracting the fibers. Moreover, it is necessary to introduce a processing device in which fibers can have an appropriate degree of freedom so as to be able to move at the time of contraction, but it is inevitable that investment on such a device is disadvantageous in view of cost.

Therefore, it is extremely difficult to obtain a bulky non-woven fabric while maintaining uniform dispersion of mass per unit area and fibers.

DISCLOSURE OF THE INVENTION

It is an object of the present invention to solve the above-described problems and provide a fiber for a wetlaid non-woven fabric, said fiber can be the basis ingredient of a paper that maintains uniform mass per unit area and fiber dispersion and has nonconventional bulkiness.

In order to achieve the object described above, the present inventors have carried out diligent research and then completed the following wetlaid non-woven fabric fiber that can produce a bulky paper by using a wet paper-making method.

Therefore, the present invention is a fiber for a wetlaid non-woven fabric, said fiber comprises 30 to 100 wt % of an apparently crimping fiber with a fiber diameter of from 3 to 40 μm and 0 to 70 wt % of a latently crimping fiber with a fiber diameter of from 3 to 40 μm.

As an embodiment of the present invention, there is a wetlaid non-woven fabric fiber described above which does not comprise a latently crimping fiber and in which the fiber length of the apparently crimping fiber is from 3 to 7 mm.

Examples of the apparently crimping fiber used in the present invention include an apparently crimping fiber, which is a synthetic fiber configured from a thermoplastic resin having a crimp number of from 5 to 25 crimps/inch and at least one of zigzag, spiral and ohmic crimp shapes is provided continuously in a length direction.

Examples of the latently crimping fiber used in the present invention include a latently crimping fiber, which is a conjugate fiber that has as a first component a propylene copolymer having a melting point Tm (° C.) of $110 \leq Tm \leq 147$ and obtained by copolymerizing one or more α-olefin other than propylene which is a main constituent, wherein a form of combination of the first component and a second component is such that the area ratio between the first component and the second component in a fiber cross-section is in the range of from 65/35 to 35/65. Examples of the second component of the latently crimping fiber which is the conjugate fibers used in the present invention include a polypropylene having a melting point of 158° C. or higher.

As another embodiment of the latently crimping fiber which is the conjugate fiber used in the present invention, there is a latently crimping fiber in which the second component is polyethylene.

The wetlaid non-woven fabric fiber of the present invention is suitable to obtain a wetlaid non-woven fabric having nonconventional bulkiness, high non-woven fabric strength and uniform mass per unit area.

Specific operational advantages obtained from the wet type non-woven fabric fiber of the present invention are as follows.

(1) The effects of bulkiness of the apparently crimping fibers and the bulkiness obtained by developing latent crimping are combined so that unprecedented bulky paper can be obtained.

(2) A good fiber dispersibility can be produced in a wet type application of crimping fibers, and uniform uniformity can be maintained, by adjusting the crimping strength or fiber length of the apparently crimping fibers and appropriately selecting a resin to configure the fibers.

(3) Even when a known heat treatment method is used to obtain a non-woven fabric, a paper maintaining unprecedented bulkiness and provided with high paper-making strength through thermal adhesion can be obtained.

The bulky non-woven fabric obtained from the wetlaid non-woven fabric fiber of the present invention can be suitably used in consumer products such as wipers, and industrial products such as filter materials and battery materials.

BEST MODE FOR CARRYING OUT THE INVENTION

Figure 1:
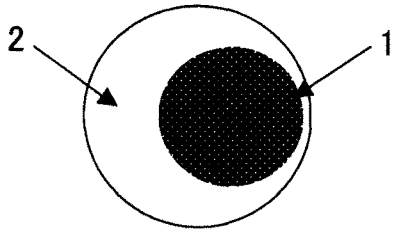
FIG. 1 illustrates a cross-sectional view of an eccentric sheath-core type conjugate fiber.

The present invention will be described hereinafter in detail.

The fiber of the present invention is a wetlaid non-woven fabric fiber having 30 to 100 wt % of apparently crimping fibers (also referred to as "fibers (A)" hereinafter) having a fiber diameter of from 3 to 40 μm and 0 to 70 wt % of latently crimping fibers (also referred to as "fibers (B)" hereinafter) having a fiber diameter of from 3 to 40 μm, as at least short fibers contributing to obtaining bulkiness of a paper, and is suitably used in a wet paper-making method of blending papers to form a web and a known processing method of performing heat processing and adhesion and mechanical interlacing and the like to obtain a non-woven fabric.

The wetlaid non-woven fabric fiber of the present invention has the apparently crimping fibers (A) as the essential component. The fiber of the present invention may include the latently crimping fibers (B) in order to further improve bulkiness of a wetlaid non-woven fabric to be obtained. Furthermore, other fiber (also referred to as "fibers (C)" hereinafter) may also be used simultaneously to obtain a non-woven fabric, so long as the effects of the present invention are not hampered. However, it is preferred that the wetlaid non-woven fabric fiber of the present invention accounts for at least 70 wt %, and particularly at least 80 wt % of whole fibers in the fabric, in terms of bulkiness.

In the wetlaid non-woven fabric fiber of the present invention, the intended bulkiness is not obtained if the content of the apparently crimping fibers (A) is less than 30 wt %, thus it is difficult to keep sufficient strength. Also, if the content of the latently crimping fibers (B) exceeds 70 wt %, the fibers thermally shrink so significantly that the web ruptures in the step of forming a web into a non-woven fabric by heat processing, thus paper cannot be obtained.

The apparently crimping fibers (A) of the present invention are synthetic fibers that are constituted by a thermoplastic resin that apparently crimp in a zigzag, spiral, ohmic or other three-dimensional form. The apparently crimping fibers (A) are preferably a single fiber (a single fiber has an opposite meaning to a conjugate fiber and is constituted by a single type of uniform composition, and it does not matter whether the component is a single resin or a mixture of two or more resins. The same applies to the following) or a conjugate fiber, which is obtained by forming various types of thermoplastic resins into a fiber in which an intersection between the apparently crimping fibers and/or an intersection between the apparently crimping fiber and other fiber configuring a paper is fused as a heat-fusible fiber.

The thermoplastic resin may be a spinnable thermoplastic resin but is not particularly limited to this. For example, polypropylene, high-density polyethylene, low-density polyethylene, linear low-density polyethylene, binary or multicomponent copolymer of propylene and other α-olefin, polyethylene terephthalate, polybutylene terephthalate, low-melting polyester having isophthalic acid as a component of a copolymer, nylon 6, nylon 66, low-melting polyamide, polyvinyl chloride, polyurethane, polystyrene, polysulfone, polytrifluorochloroethylene, polytetrafluoroethylene, and a combination thereof can be used.

When the apparently crimping fibers (A) of the present invention are heat-fusible conjugate fibers, conjugate fibers can be used in which the difference in melting points among a plurality of thermoplastic resins is at least 10° C. and a low-melting point thermoplastic resin forms at least a part of a fiber surface. Examples of the conjugate fiber include a conjugate fiber the fiber cross-section of which is in the form of a sheath core, side-by-side shape, sea island, hollow, multi-splittable shape or the like. However, in view of bulkiness, a solid sheath-core type, a side-by-side type, and an sea island type can be preferably be used in order to provide the fiber with rigidity. Furthermore, an eccentric sheath-core type, which is disposed in a section in which the weighted center of a side-by-side type or sheath-core type high-melting point thermoplastic resin is different from the position of the weighted center of the fiber cross-section, can be preferably used, said side-by-side type or sheath-core type high-melting point thermoplastic resin actuating spiral three-dimensional crimping easily.

Examples of a combination of thermoplastic resins configuring the conjugate fiber include high-density polyethylene/polypropylene, low-density polyethylene/polypropylene, binary or multicomponent copolymer of propylene and other α-olefin/polypropylene, high-density polyethylene/ polyethylene terephthalate, low-density polyethylene/polyethylene terephthalate, linear low-density polyethylene/polyethylene terephthalate and the like.

When the apparently crimping fibers (A) of the present invention are heat-fusible polyolefin conjugate fibers, the component used in the high-melting point thermoplastic resin is preferably crystalline polypropylene resin having a melting point of at least 158° C., in view of improving stiffness of the resin. In the apparently crimping fibers (A) it is considered that bulkiness of the paper relies on the stiffness of the fiber having a crimp. Specifically, it is considered that the stiffness of the fiber relies on the component of the high-melting point thermoplastic resin of the fiber because the low-melting thermoplastic resin functions to perform melt adhesion in the heat-fusible fiber. Therefore, with regard to the high-melting point resin, a highly crystalline resin is considered preferable. However, there is a case in which other polyolefin is selected in view of spinnability and drawing ability of the fiber and dispersibility of an obtained fiber that is produced through a wet paper-making method.

Moreover, when the apparently crimping fibers (A) are conjugate fibers, the area ratio between the constituent resin components, i.e., low-melting point thermoplastic resin/high-melting point thermoplastic resin (in the case of the sheath-core type composite resin, the area ratio between a low-melting point thermoplastic resin, which is the sheath component, and a high-melting point thermoplastic resin, which is the core component, in a cut surface that is obtained by cutting the fiber in a direction perpendicular to the axial direction thereof), is preferably in the range of from 70/30 to 30/70, and more preferably in the range of from 60/40 to 40/60. Furthermore, in order to provide the fiber with stiffness, it is preferable to increase the ratio of the high-melting point component so that the area ratio between the low-melting point thermoplastic resin and the high-melting point thermoplastic resin falls in the range of from 50/50 to 40/60.

When the apparently crimping fibers (A) of the present invention are conjugate fibers, the low-melting point component, which is continuously exposed in a length direction at a part of the surface of the fiber, can be caused to contain a resin (denaturant) comprising a polymer constituted of vinyl monomer having a reactive functional group.

The denaturant is a resin having a reactive functional group, and examples of the reactive functional group include hydroxyl group and amino, nitrile, nitrilo, amid, carbonyl, carboxyl, glycidyl groups and the like. Modified polyolefin can be polymerized using vinyl monomer having the reactive functional group, and any of block, random, ladder copolymers and graft copolymer. Examples of the vinyl monomer having the reactive functional group include vinyl monomer comprising at least one of unsaturated carboxylic acid selected from maleic anhydride, maleic acid, acrylic acid, methacrylic acid, fumaric acid, itaconic acid and the like, a derivative thereof and an anhydride thereof, vinyl monomer comprising at least one of styrenes such as styrene and α-methylstyrene, esters of methacrylic acid such as methyl methacrylate, ethyl methacrylate, 2-hydroxy ethyl methacrylate and dimethylamino ethyl methacrylate, and similar esters of acrylic acid, and vinyl monomer comprising at least one of glycidyl acrylate, glycidyl methacrylate, esters of butene carboxylic acid, allyl glycidyl ether, 3,4-epoxy butene, 5,6-epoxy-1-hexene, vinylcyclohexene monoxide and the like.

It is preferred that the above denaturant generally have the vinyl monomer with the reactive functional group at a modification ratio of from 0.05 to 2.0 mol/kg with respect to the total weight of the denaturant, and it is preferable to use a denaturant having a Modification ratio of from 0.05 to 0.2 mol/kg.

In the case in which the thermoplastic resin blended with the above denaturant is a polyolefin resin or a polyester resin, according to the present invention, modified polyolefin constituted of vinyl monomer composed of unsaturated carboxylic or a derivative thereof and polyolefin can be preferably used as a denaturant, since when a fiber obtained by blending the resin and the denaturant is processed into a non-woven fabric, adhesiveness between the fiber and other cellulose fiber or inorganic substance is high and hydrophilic property is improved because the fiber surface has the functional group.

Of the abovementioned modified polyolefins, the modified polyolefin which is the graft copolymer has strong polymer and good fiber processability, and thus can be used more preferably, and it is preferred that the modification ratio be high such that the fiber processability and the effects of the present invention are not hampered.

With regard to a trunk polymer of the modified polyolefin, polyethylene, polypropylene, polybutene-1 and the like can be used. High-density polyethylene, linear low-density polyethylene, and low-density polyethylene can be used as the polyethylene. These are polymers having a density of from 0.90 to 0.97 g/cm$^3$ and a melting point of from 100 to 135° C. As the polypropylene, a propylene homopolymer, or a copolymer of propylene and other α-olefin that has propylene as the main constituent is used. These are polymers having a melting point of approximately 130 to 170° C. Polybutene-1 is a polymer having a melting point of approximately 110 to 130° C.

Of these polymers, polyethylene is preferred in view of the melting point, and facility of copolymerization and graft copolymerization, and high-density polyethylene is more preferable in order to improve non-woven strength, because it has high polymer strength.

A single modified polyolefin, a mixture of at least two types of modified polyolefin, a mixture of at least one type of modified polyolefin and other thermoplastic resin, or the like can be used as the low-melting component having the abovementioned modified polyolefin.

When comparing modified polyolefin with unmodified polyolefin, the polymer strength of the modified polyolefin tends to decrease, thus it is preferable to use a mixture of modified polyolefin having a high modification ratio and unmodified polyolefin, as a low-melting point component, in order to keep the fiber strength higher.

When blending the denaturant with other thermoplastic resin, it is preferable to use a denaturant having a high modification ratio of approximately 0.1 mol/kg or more. By using the denaturant, the effect of improving the electrostatic property of the paper configured by the fiber for wetlaid non-woven fabric fiber according to the present invention can be provided. Furthermore, it is preferable to blend the denaturant with a thermoplastic resin same as the trunk polymer configuring the denaturant. As this other thermoplastic resin to be blended, it is particularly preferable to use a polymer same as the trunk polymer of the modified polyolefin, in view of compatibility.

The fiber diameter of the apparently crimping fibers (A) in the present invention is from 3 to 40 μm. It is preferred that the fiber diameter be from 10 to 30 μm in view of the dispersibility of the fiber in water when using the wet paper-making method, the mixing property of the fiber with the latently crimping fiber (B) described hereinafter or other fibers (C), and the texture of the paper to be obtained. The thicker the fiber diameter of the crimping fiber, the higher the rigidity thereof, thus bulkiness of the fiber is improved. Therefore, it is easier to obtain a bulky paper by using a thicker fiber, but the diameter of a pore between fibers becomes loose and thereby a paper with a small number of gaps is obtained, thus a target matter cannot be captured when applied to a filter or a wiper and a function of a separation membrane cannot be exercised when applied to a battery separator, impairing the primary function.

It is considered that the fiber diameter of from 3 to 40 μm residing in the fiber configuring the wetlaid non-woven fabric fiber of the present invention is suitable for combining bulkiness and stiffness desired in a paper with a film function.

In the apparently crimping fiber (A) according to the present invention, it is preferable that the crimps in the shape of at least one of zigzag form, spiral form and ohmic form are provided continuously in a length direction with a crimp number of from 5 to 25 crimps/inch. Moreover, the shape of the crimp is preferably in a three-dimensional form such as a spiral or ohmic form in view of bulkiness of the paper, and the number of crimps is preferably from 5 to 10 crimps/inch in view of dispersibility of the fiber in the wet paper-making method. Furthermore, in view of bulkiness of the paper, a fiber in which the crimp shape thereof is fixed by means of steam in the step of providing a crimp can be used.

The fiber length of the apparently crimping fiber (A) of the present invention can be from 3 to 30 mm in view of bulkiness and paper strength of the obtained paper. Also, in view of dispersibility of the fiber in water, which is revealed in the wet paper-making method, or the mixing property of the fiber with the latently crimping fiber (B) described hereinafter or other fiber, it is preferred that the fiber length be from 3 to 15 mm. The high apparently crimping fiber (A) having a crimp number of from 15 to 25 crimps/inch, or the one which is cut into 3 to 7 mm and the shape of which is fixed by means of steam is preferably used.

When the wetlaid non-woven fabric fiber of the present invention is configured not to include the latently crimping fiber (B), the bulkiness effect of the present invention relies on the apparently crimping fiber (A), thus the shape of a crimp of the apparently crimping fiber (A) is preferably fixed using steam, or the number of crimps of the apparently crimping fiber (A) is preferably as high as 15 to 25 crimps/inch. At this moment, regarding the fiber length, the one which is cut into 3 to 7 mm is preferably used in view of the dispersibility of the fiber in water when using the wet paper-making method, the mixing property of the fiber with other fiber.

The latently crimping fiber (B) according to the present invention is suitably a latently crimping conjugate fiber. Examples of a first component configuring the latently crimping conjugate fiber include, in view of processability, a propylene copolymer, which thermally shrink at relatively low temperature and has a fiber-forming property, and the melting point Tm (° C.) of which is in the range of $110 \leq Tm \leq 147$. Such propylene copolymer can be obtained by copolymerizing propylene, which is a main constituent, and α-olefin other than the propylene. Examples of such α-olefin include ethylene, butene-1, pentene-1, hexene-1, heptene-1, octene-1, 4-methyl-pentene-1 and the like, and two or more of these α-olefin can be used simultaneously. Specific examples of the propylene copolymer include ethylene-propylene binary copolymer, propylene-butene-1 binary copolymer, ethylene-propylene-butene-1 terpolymer, propylene-hexene-1 binary copolymer, propylene-octene-1 binary copolymer and the like, and a combination thereof. These copolymers are normally random copolymers, but may be block copolymers.

Regarding the propylene copolymer, which is used as the first component of the fiber (B) of the present invention, that is, the latently crimping conjugate fiber, and the melting point Tm (° C.) of which is in the abovementioned range, it is preferred in view of cost to use ethylene-propylene-butene-1 terpolymer consisting of 90 to 98 wt % propylene, 1 to 7 wt % ethylene and 1 to 5 wt % butene-1, and ethylene-propylene binary copolymer consisting of 90 to 98 wt % propylene and 2 to 10 wt % ethylene are preferred, and it is more preferred to use ethylene-propylene binary copolymer consisting of 90 to 96 wt % propylene and 4 to 10 wt % ethylene, and ethylene-propylene-butene-1 terpolymer consisting of 90 to 96 wt % propylene, 3 to 7 wt % ethylene and 1 to 5 wt % butene-1 as the first component in view of low-temperature processability and contraction force when performing contraction processing using heat.

It should be noted that, out of these resins, the one having a melting point Tm (° C.) of lower than 110° C. has strong rubber elasticity and thus tends to impinge on the dispersibility of an obtained fiber in water. Moreover, when the propylene copolymer having a melting point Tm (° C.) of over 147° C. is used as the first component, the contraction force of the obtained fiber tends to deteriorate to the level of normal polypropylene single component fibers or polyethylene/polypropylene conjugate fibers. Therefore, the latently crimping fiber (B) having both dispersibility and heat shrinkable property of fibers can be suitable obtained by using the propylene copolymer as the first component, the propylene copolymer having the compositions in the abovementioned ranges.

It should be noted that titanium dioxide, calcium carbonate, magnesium hydrate, or other inorganic substances, a fire retardant, a pigment, and other polymers may be added to the first component according to need, so long as the heat shrinkable property of the fiber of the present invention is not excessively deteriorated or is slightly suppressed.

As a second component of the fiber (B) which is the latently crimping fiber used in the present invention, a polypropylene having a melting point of 158° C. or higher is preferably used. The polypropylene having a melting point of 158° C. or higher is a crystalline polypropylene excellent in surface smoothness and is homopolypropylene or a copolymer of propylene and a small amount, normally 2 wt % or less of α-olefin.

Examples of such polypropylene include crystalline polypropylenes obtained from a general Ziegler-Natta catalyst or metallocene catalyst. Of these, a crystalline polypropylene having a narrow distribution of molecular weight in which a Q value (weight-average molecular weight/number average molecular weight) to be measured by an after-mentioned method is as small as, preferably, 4 or less, or more preferably 3 or less can be preferably used in view of spinnability and a latent crimping property.

As the second component, combination of two or more of these crystalline polypropylenes, or combination of the crystalline polypropylene with other crystalline polypropylene or thermoplastic resin having a different distribution of molecular weight or MFR can be used, or titanium dioxide, calcium carbonate, magnesium hydrate, or other inorganic substances, a fire retardant, a pigment, and other polymers may be added according to need, so long as the effects of the present invention are not hampered.

In the latently crimping fiber (B) of the present invention, if the second component is a polypropylene having a melting point of 158° C. or higher, since this melting point is normally higher than the melting point Tm (° C.) of the first component, the propylene copolymer of the first component can be used as a heat-fusible component of the fiber. Specifically, a web that is obtained by interlacing fibers by means of high-water pressure streams is subjected to a method such as emboss processing or heat-pin processing to thermally adhere the fibers, whereby the strength of a thus obtained non-woven fabric can be improved so long as the soft touch and bulkiness thereof are not hampered, and also stretchability of the non-woven fabric can be adjusted. Particularly, when performing heat processing at temperature of equal to or lower than 158° C., which is a melting point of the polypropylene of the second component, and in the range of at least the melting point of the propylene copolymer of the first component, non-woven fabric formation and contraction processing can be performed simultaneously, whereby a step of manufacturing a non-woven fabric can be simplified. It is desired that the difference in the melting points Tm (° C.) between the first and second components be at least 13° C. or preferably at least 23° C.

As the second component of the fiber (B) which is the latently crimping conjugate fiber of the present invention, polyethylene is also preferably used. Examples of available polyethylene include high-density polyethylenes, linear low-density polyethylene and low-density polyethylene, which are largely categorized by the melting points and density described hereinafter.

The high-density polyethylene described in the present invention is an ethylene homopolymer or an ethylenic copolymer containing a small amount—normally up to 2 wt %—of C3 through C12 higher alkenes as comonomers that is obtained by polymerization by means of a known Ziegler-Natta catalyst through low-pressure processing, and is generally a polyethylene having a density of from 0.941 to 0.965 g/cm$^3$ and a melting point of 127° C. or higher.

The linear low-density polyethylene described in the present invention indicates an ethylenic copolymer which is obtained by polymerization by means of a known Ziegler-Natta catalyst, does not have a substantially long branched chain, and contains normally 15 wt % or less C3 through C12 higher alkenes as comonomers, and is generally a polyethylene having a density of from 0.925 to 0.940 g/cm$^3$ and a melting point of lower than 127° C.

The low-density polyethylene described in the present invention is a low-crystalline polyethylene which is obtained by polymerization through high-pressure processing, generally has a density of from 0.910 to 0.940 g/cm$^3$ and a melting point of 120° C. or lower, and has many branched chains.

Furthermore, a polyethylene resin obtained by polymerization using a metallocene catalyst is advantageous in terms of low-temperature processability exercised when thermally adhering fibers, because it has a melting point lower than that of the abovementioned resins, and also said polyethylene resin can be preferably used as the second component according to the present invention since it has a narrow distribution of molecular weight to largely contribute to spinning stability.

The second component of the fiber (B) serving as the latently crimping fiber according to the present invention is provided with low-temperature processability and processing stability, thus several resins selected from these polyethylenes can be combined, or, so long as the object of the present invention is not prevented from being achieved, titanium dioxide, calcium carbonate, magnesium hydrate, or other inorganic substances, a fire retardant, a pigment, and other polymers may be added to the second component according to need.

By using a polyethylene having a melting point lower than the melting point Tm (° C.) of the first component in the second component of the fiber (B) which is the latently crimping fiber according to the present invention, thermal adhesiveness can be provided to the fiber. Specifically, if a resin that generates a difference in the melting points between the first component and the second component is selected according to need, a web that is obtained by interlacing fibers by means of high-water pressure streams is subjected to a method such as emboss processing or heat-pin processing to thermally adhere the fibers, whereby the strength of a thus obtained non-woven fabric can be improved so long as the soft touch and bulkiness thereof are not hampered, and also stretchability of the non-woven fabric can be adjusted. Particularly, when performing heat processing at temperature of equal to or lower than the melting point of the first component and equal to or higher than the melting point of the second component, non-woven fabric formation and contraction processing can be performed simultaneously, whereby a step of manufacturing a non-woven fabric can be simplified. It is desired that the melting point of the second component be lower than the melting points Tm (° C.) of the first component by at least 5° C. or preferably at least 10° C.

The area ratio between the first component and the second component of the latently crimping fiber (B) according to the present invention (i.e., the area ratio between the sheath component and the core component in a cut surface that is obtained by cutting the fiber in a direction perpendicular to the axial direction thereof) is preferably in the range of from 35/65 to 65/35, and more preferably from 45/55 to 55/45. If this area ratio is at least 35/65 (preferably at least 45/55), a contraction force generated by a latent crimping property during heat processing (during contraction processing) can provide sufficient crimps to the fiber, thus a bulky non-woven fabric can be obtained. If the area ratio is 65/35 or lower (preferably 55/45 or lower), the non-woven fabric can be caused to shrink uniformly without causing the fiber to excessively shrink, thus no fiber mass is generated.

Figure 2:
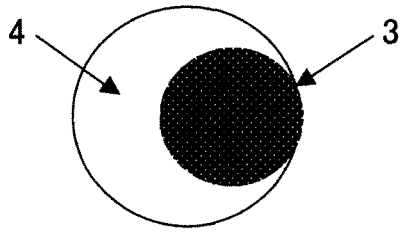
FIG. 2 illustrates a cross-sectional view of a side-by-side type conjugate fiber, particularly a crescent-shaped conjugate fiber.
Figure 3:
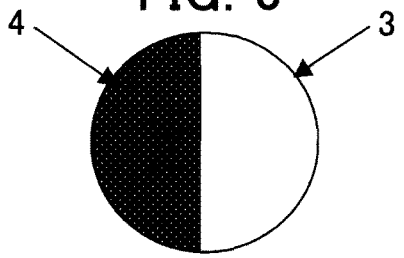
FIG. 3 illustrates a cross-sectional view of a side-by-side type conjugate fiber, particularly a half-moon type conjugate fiber (shape that is obtained by combining the ratios of cross-sectional areas occupied by the fiber as much as possible).
Figure 4:
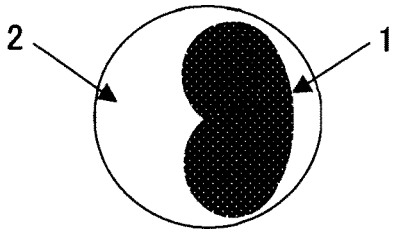
FIG. 4 illustrates an example of a cross-sectional view of an eccentric sheath-core type conjugate fiber having a non-circular core.

The cross-sectional view of the latently crimping fiber (B) according to the present invention is shown in FIGS. 1 to 4. A preferred conjugate pattern of the first component and the second component in the latently crimping fiber (B) according to the present invention is an eccentric sheath-core type fiber in which the first component is disposed on the sheath side when the second component is a polypropylene having a melting point of 158° C. or higher. This is because when the conjugate fiber has an eccentric sheath-core type structure, crimps that can sufficiently produce bulkiness during heat processing can be easily produced. The arrangement of the eccentric sheath-core type fiber is generally expressed in the cross-sectional shape shown in FIG. 1, but the latent crimping property can be enhanced even if the eccentricity is increased such that a part of the second component is exposed to the surface of the fiber as shown in FIG. 2, thus this arrangement can be adopted so long as the effects of the present invention are not hampered by friction of the second component exposed partially to the fiber surface. Furthermore, the latent crimping property can be enhanced most when the second component exposed as shown in FIG. 3 covers 50% of the fiber surface, thus this arrangement can be adopted so long as the processability and thermal adhesiveness of the fiber of the present invention are not hampered. Moreover, as shown in FIG. 4, the latent crimping property can be enhanced by a heat shrinkage difference when the cross-sectional shape of the core component is deformed (non-circular).

When the second component of the latently crimping fiber (B) according to the present invention is a polyethylene, an eccentric sheath-core type fiber in which the second component is disposed on the sheath side is preferred. This is because when the conjugate fiber has an eccentric sheath-core type structure, crimps that can sufficiently produce bulkiness during heat processing can be easily produced. The arrangement of the eccentric sheath-core type fiber is generally expressed in the cross-sectional shape shown in FIG. 1, but the latent crimping property can be enhanced even if the eccentricity is increased such that a part of the first component is exposed to the surface of the fiber as shown in FIG. 2, thus this arrangement can be adopted so long as the effects of the present invention are not hampered by friction of the first component exposed partially to the fiber surface. Furthermore, the latent crimping property can be enhanced most when the first component exposed as shown in FIG. 3 covers 50% of the fiber surface, thus this arrangement can be adopted so long as the processability and thermal adhesiveness of the fiber of the present invention are not hampered. Moreover, as shown in FIG. 4, the latent crimping property can be enhanced by a heat shrinkage difference when the cross-sectional shape of the core component is deformed (non-circular).

It is preferred that the latently crimping fiber (B) according to the present invention show a heat shrinkage rate of at least 30%, which is measured by a method described hereinafter, in a state in which the latently crimping fiber (B) is independently processed into a web by means of a wet paper-making method. When the heat shrinkage rate falls significantly below 30%, crimping is not sufficient, thus the bulkiness of a non-woven fabric obtained by the latently crimping fiber (B) and the apparently crimping fiber (A) tends to be low.

The fiber diameter of the latently crimping fiber (B) according to the present invention is from 3 to 40 μm. When the diameter of the latently crimping fiber (B) exceeds 40 μm, rigidity of the fiber increases, thus latent crimping that is developed at the time of heat shrinkage is weak. Moreover, in view of the dispersibility of the fiber in water when using the wet paper-making method, the mixing property of the fiber with the abovementioned apparently crimping fiber (A) or other fiber, and the soft touch of the paper to be obtained, the fiber diameter is preferably from 10 to 25 μm.

For the latently crimping fiber (B) according to the present invention, it is possible to use a fiber which produces crimping as it thermally shrinks and apart from the latent crimps, has crimps that is configured in at least one of the zigzag form and ohmic form continuously in a length direction with a crimp number of from 5 to 25 crimps/inch, so long as the effects of the present invention are not hampered. However, the number of crimps of at least one of the zigzag crimps and ohmic crimps is preferably from 5 to 10 crimps/inch in view of the decrease of the number of developed latent crimps by providing crimping or in view of the dispersibility of the fiber.

It is suitable that the fiber length of the latently crimping fiber (B) according to the present invention is from 3 to 30 mm in view of the bulkiness or strength of the obtained paper. Furthermore, in view of the mixing property of the fiber with the abovementioned apparently crimping fiber (A) or other fiber when using the wet paper-making method, or the developing property of the latent crimping obtained through heat shrinkage, it is preferred that the fiber length be from 3 to 15 mm.

A step of manufacturing a heat-adhesive conjugate fiber used as the apparently crimping fiber (A) and latently crimping fiber (B) in the present invention is described hereinafter.

A thermoplastic resin is spun by means of a normally used melt spinning machine by using a side-by-side type spinning nozzle such that a low-melting point thermoplastic resin forms at least a part of the fiber surface, a sheath-core type spinning nozzle in which the low-melting point thermoplastic resin is constitutes a sheath component and a high-melting point thermoplastic resin constitutes a core component, or an eccentric sheath-core type spinning nozzle. At this moment, an undrawn heat-adhesive conjugate fiber is manufactured by sending air to an area immediately below the spinning nozzle using a quench to cool a semi-molten thermoplastic resin. At this moment, the discharge rate of the molten thermoplastic resin and the speed of pulling-up the undrawn yarn are arbitrarily set to obtain an undrawn yarn that has a diameter of one through five times the fiber diameter of a target fineness.

It should be noted that when the percentage of the low-melting point thermoplastic resin forming the fiber surface is at least 50% with respect to the fiber cross section circular ratio, sufficient thermal adhesive force is obtained, and especially when it is from 50 to 100% the thermal adhesive force is intense, which is preferable, but the percentage of the low-melting point thermoplastic resin is not necessarily limited to these values for improving an electret property as well. A drawn yarn (a heat-adhesive conjugate fiber obtained before crimping process is performed) can be obtained by drawing the obtained undrawn yarn using a normally used drawing machine. It should be noted that normally drawing process is performed between rolls heated to from 40 to 120° C. so that the speed ratio between the rolls falls in the range of from 1:1 to 1:5. The obtained drawn yarn is, if desired, applied with crimps by a box crimper and formed into a tow.

Adhesion of a fiber treatment agent is performed by at least one step of a method of adhering using a kiss-roll when pulling-up the undrawn fiber, a touch-roll method when/after the undrawn yarn is drawn, a dipping method, a method of adhering using an atomization method and the like. The tow is cut into an arbitrary fiber length according to intended use by using a push cutter and then used.

Another fiber (C) that can be added besides the wetlaid non-woven fabric fiber of the present invention when manufacturing a wetlaid non-woven fabric is not particularly limited, thus, for example, polyolefin fibers such as polypropylene, polyethylene, polyethylene/polypropylene conjugate fiber and the like, polyester fibers such as polyethylene terephthalate, polybutylene terephthalate and the like, polyamide fibers such as nylon 6, nylon 66 and the like, biodegradable fibers such as polylactic acid, polybutylene succinate and the like, synthetic fibers such as rayon fibers, artificial pulp and the like, natural fibers such as softwood pulp, hardwood pulp, pulp, cotton, hemp and the like can be used according to the intended use.

A bulky wetlaid non-woven fabric is obtained by forming a web into a non-woven fabric by means of other known processing methods such as heat treatment adhesion, mechanical interlacing including a spun lace method, and the like, the web being obtained by forming the wetlaid non-woven fabric fiber of the present invention alone into a paper or mixing it with other fiber to form a paper. A non-woven fabric formation method such as mechanical interlacing is not sufficient for interlacing a fiber of a paper-making web to have a short fiber length, and stronger interlacing force can be obtained when integrating fibers by thermal adhesion, thus a non-woven fabric formation method using heat treatment adhesion is preferred in order to obtain a bulky and strong paper.

In order to manufacture a bulky wetlaid non-woven fabric, the wetlaid non-woven fabric fiber of the present invention is subjected to paper making independently or in combination with other fiber to form a web by using a paper machine that uses water as a medium. For example, a cylinder paper machine, a fourdrinier paper machine or the like can be used as the paper machine. A simplified paper machine provided with a water tank, an agitator, a screen and the like can also be used. The obtained web is subjected to dehydration processing or consolidation processing, or is not subjected to any processing, to be formed into a non-woven fabric by means of the known processing method such as various heat treatment, mechanical interlacing including a spun lace method and the like, to obtain a paper. The non-woven fabric formation method such as mechanical interlacing easily produces bulkiness because the fibers are not fixed sufficiently, and again is not sufficient for interlacing a fiber of a paper-making web to have a short fiber length, and in this method, sufficient non-woven fabric strength may not be obtained, on the other hand, stronger interlacing force is obtained when integrating the fibers by thermal fusion. A non-woven fabric formation method using heat treatment adhesion is preferred in order to obtain a bulky and strong paper.

In order to manufacture a bulky wetlaid non-woven fabric, in a step of performing heat treatment on the web obtained by mixing fibers using mainly a wet paper-making method, it is necessary to develop latent crimps of the latently crimping conjugate fiber (B) while keeping the bulkiness effect of the apparently crimping fiber (A) according to the present invention, and at the same time to uniformly subject the web to heat shrinkage and/or adhesion to integrate the fibers.

In the heat treatment, a generally used hot air circulating device, a floating dryer, or other heat treatment device can be used, and the floating dryer capable of uniformly transmitting heat throughout the web is preferably used. This device is characterized in ejecting hot air from a nozzle installed on an upper surface and a lower surface of a transfer space of a web, floating the web using the hot air, performing simultaneously air transfer and causing the fibers to shrink thermally, to obtain a uniform non-woven fabric. However, in order to prevent the web from being cut and the fibers from scattering, it is important to temporarily tack the web by using a known non-woven fabric processing method such as a needlepunching method, an emboss roll method, an ultrasonic fusing method and/or a high-pressure water-flow interlacing method and the like, when using any of the above devices. Moreover, another preferred method for temporarily adhering the web may be preferably used in which the web is caused to include a component to be thermally adhered at a low temperature at which the apparently crimping fiber (A) and the latently crimping fiber (B) according to the present invention do not perform heat fusing and/or contraction.

The mass per unit area of the non-woven fabric obtained using the wetlaid non-woven fabric fiber of the present invention is selected appropriately according to the intended use. For example, when the non-woven fabric is used in a moist towelette, a sliding-screen paper, a battery material or the like, the non-woven fabric of from 5 to 100 g/m$^2$ is preferably used, and when the non-woven fabric is used in a filter material, a civil engineering material or the like, the non-woven fabric of from 50 to 2000 g/m$^2$ is preferably used, but the mass per unit area is not limited to these values. Furthermore, the non-woven fabric can be stacked with a short fiber non-woven fabric such as a card non-woven fabric, an airlaid non-woven fabric and the like, or a long fiber non-woven fabric such as a spunbonded non-woven fabric, a meltblown non-woven fabric and the like, according to the purpose.

By using the wetlaid non-woven fabric fiber of the present invention, it makes possible to easily obtain a strong pager that has a specific volume of at least 10 cm$^2$/g or particularly at least 13 cm$^2$/g, simultaneously, with a uniform mass per unit area and uniform dispersibility of fibers, although such paper was difficult to be obtained conventionally.

EXAMPLES

Next, the present invention is specifically described using examples, but the present invention is not limited to the following examples only. It should be noted that the definitions of the terms and the measurement methods used in the examples and comparative examples are as follows.

(1) Melting point: (unit: ° C.)

The temperature corresponding to the peak on a fusion absorption curve, which is obtained when increasing the temperature of a thermoplastic polymer at 10° C./min, is taken as a melting point of the thermoplastic polymer by using a differential scanning calorimeter DSC-Q10 manufactured by TA Instruments.

(2) MFR: (unit: g/10 minutes)

Measured according to JIS-K-7210, Condition 14 (230° C., 21.18 N). MFR is a value measured using the thermoplastic polymer as a specimen.

(3) Q value: (weight-average molecular weight/number average molecular weight)

Q value is a ratio (Mw/Mn) between the weight-average molecular weight (Mw) and the number average molecular weight (Mn) of the thermoplastic polymer, which is obtained using a gel permeation chromatography method. Here, a value of the thermoplastic polymer obtained before spinning is shown.

(4) Fineness: (unit: dtex)

Measured according to JIS-L-1015.

(5) Fiber diameter (unit: μm)

Calculated from the fineness and a specific gravity configuring the fibers by means of the following equation.

$$\text{Fiber diameter } (\mu m) = \text{Fineness (dtex)}/\{(\text{Specific gravity of first component resin} \times \text{Fiber configuration ratio} + \text{Specific gravity of second component resin} \times \text{Fiber configuration ratio})/10^6/3.14\} \times 10^4 \times 2$$

(6) Number of crimps: (unit: number of crimps/2.54 cm)

For a short fiber specimen, crimps per 2.54 cm of ten fibers are counted, and the averaged value of the crimps is taken as the number of crimps herein.

(7) Strength per yarn: (unit: cN/dtex)

Measured according to JIS-L-1015.

(8) Heat shrinkage rate: (unit: %)

A 25×25 cm web having a mass per unit area of approximately 80 g/m$^2$ was created using a simplified paper machine (TAPPI), subjected to dehydration processing, thereafter placed on a craft paper and then put in a convective hot air dryer that is kept at 145° C., to perform heat processing for five minutes. The length of each of side of the heat-processed web was measured, and the heat shrinkage rate was calculated using the following equation.

$$\text{Heat shrinkage rate (\%)}=(1-a/25)\times 100$$

It should be noted that "a" in the equation is the length of each side of the heat-processed web.

(9) Fiber dispersibility

Dispersibility of wet fibers in water (spreading property of the fibers, dispersibility of the fibers) was measured and evaluated on three scales.

Good (O): Most preferred spreading property and dispersing state of the fibers.

Fair (Δ): Either the spreading property or dispersibility of the fibers is fairly good.

Poor (x): Poor spreading property and dispersibility of the fibers (bonding, entangling of the fibers) are observed.

(10) Uniformity

Uniformity of a paper having a mass per unit area of approximately 70 g/m$^2$ was visually determined on the basis of the following three scales.

Good (O): A non-woven fabric that thermally shrinks uniformly has a good uniformity.

Fair (Δ): A non-woven fabric that thermally shrinks substantially uniformly and has a slightly disordered uniformity but is not considered as a substantial problem in practical use.

Poor (x): A non-woven fabric that does not thermally shrink uniformly and has a small shrinkage rate.

(11) Specific volume (unit: cm$^3$/g)

The paper having a mass per unit area of approximately 70 g/m$^2$ is measured at a pressure of 2 g/m$^2$, and a specific volume is calculated from thus obtained thickness by means of the following equation, and bulkiness was compared.

$$\text{Specific volume (cm}^3\text{/g)}=\text{Thickness (mm)/Mass per unit area (g/m}^2\text{)}\times 1000$$

(12) Non-woven fabric strength: (unit: N/5 cm)

A paper having a mass per unit area of approximately 70 g/m$^2$ was cut into three strips of 15×5 cm, and a 5 cm part of each of the top and bottom elongated portion was taken as a sandwiching margin of a zipper, and a test was conducted on a 10 cm part between the zippers to pull it vertically at 200 m$^2$/sec by means of a tension tester manufactured by Shimadzu Seiki Ltd. From the measurement results, the maximum stress and the degree of elongation at the time of rupture of the non-woven fabric were determined.

Examples 1 to 6 and Comparative Examples 1 to 4

(1) Various apparently crimping fibers (A-1), (A-2) and (A-3) were manufactured as the apparently crimping fiber (A) according to the present invention.

As shown in Table 1, any of the crystalline propylenes having different values was used as the first component, any of the high-density polyethylenes having different MFRs were used as the second component, and an extruder, a spinning device provided with a side-by-side type spinning nozzle having a pore size of 0.8 mm, a winding device and the like, and a drawing device provided with a multistage heating roller and a stuffer box crimper (capable of fixing a crimp shape by means of steam) were used to manufacture various conjugate fibers. It should be noted that (A-1) was applied with a steam pressure of 0.002 Mpa by means of a crimping equipment, and fixing processing was performed on the crimp shape.

(2) Various latently crimping fibers (B-1), (B-2) and (B-3) were manufactured as the latently crimping fiber (B) according to the present invention.

As shown in Table 1, an ethylene-propylene binary copolymer was used as the first component, a crystalline polypropylene having a small Q value was used as the second component, and an extruder, a spinning device provided with a side-by-side type spinning nozzle having a pore size of 0.8 mm, a winding device and the like, and a drawing device provided with a multistage heating roller and, according to need, a stuffer box crimper were used to manufacture various conjugate fibers.

(3) For comparison, various fibers (C-1), (C-2) and (C-3) which are the fibers (C) that are not provided with apparent crimps and that hardly produce latent crimping property were manufactured.

As shown in Table 1, a crystalline polypropylene having a small Q value was used as the first component, high-density polyethylenes having different MFRs were used as the second component, and an extruder, a spinning device provided with either a side-by-side type spinning nozzle or a concentric sheath-core spinning nozzle having a pore size of 0.8 mm, a winding device and the like, and a drawing device provided with a multistage heating roller were used to manufacture various conjugate fibers.

For the detail of each of the conjugate fibers, resins configuring the fibers, manufacturing conditions, and the shape of the fibers are shown in Table 1, and the data items related to on the yarn material and crimp shape of the fibers, dispersibility of each fiber in water, heat shrinkage of each fiber and the like are shown in Table 2. It should be noted that an apparently crimping fiber (A-2') shown in Table 2 is obtained by changing the fiber length of (A-2).

Figure 5:
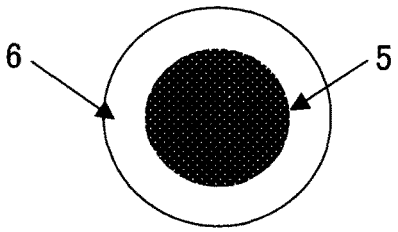
FIG. 5 illustrates a cross-sectional view of the eccentric sheath-core type conjugate fiber.

The specific cross-sectional shapes of the fiber that are described in Table 1 are shown in FIGS. 2, 3 and 5. In the table, Homo-PP represents the crystalline polypropylene, HDPE represents the high-density polyethylene, and co-PP represents the ethylene-propylene copolymer (3.5 wt % ethylene component) having a density of 0.922 g/cm$^3$.

TABLE 1

| Fiber type | | Composition resin | | Melting point ° C. | MFR g/10 min | Density g/cm$^3$ | Q value Mn/Mw | Composition ratio Vol % | Fiber cross-sectional shape | Spinning temperature ° C. | Draw ratio | Use of steam |
|---|---|---|---|---|---|---|---|---|---|---|---|---|
| Apparently crimping fiber | A-1 | 1$^{st}$ component | Homo-PP | 162 | 11 | 0.91 | 4.9 | 50 | Crescent shape (FIG. 2) | 250 | 4.3 | 0.002 MPa |
| | | 2$^{nd}$ component | HDPE | 133 | 26 | 0.961 | 5.6 | 50 | | 220 | | |
| | A-2 | 1$^{st}$ component | Homo-PP | 162 | 11 | 0.91 | 4.9 | 50 | Crescent shape (FIG. 2) | 250 | 4.3 | None |
| | | 2$^{nd}$ component | HDPE | 133 | 26 | 0.961 | 5.6 | 50 | | 220 | | |
| | A-3 | 1$^{st}$ component | Homo-PP | 159 | 7.8 | 0.91 | 3.5 | 50 | Crescent shape (FIG. 2) | 250 | 4.3 | None |
| | | 2$^{nd}$ component | HDPE | 133 | 26 | 0.961 | 5.6 | 50 | | 220 | | |

TABLE 1-continued

| Fiber type | | Composition resin | | Melting point ° C. | MFR g/10 min | Density g/cm$^3$ | Q value Mn/Mw | Composition ratio Vol % | Fiber cross-sectional shape | Spinning temperature ° C. | Draw ratio | Use of steam |
|---|---|---|---|---|---|---|---|---|---|---|---|---|
| Latently crimping fiber | B-1 | 1$^{st}$ component | co-PP*$^1$ | 130 | 17 | 0.922 | 3.1 | 50 | Half-moon shape (FIG. 3) | 220 | 1.9 | None |
| | | 2$^{nd}$ component | Homo-PP | 159 | 7.8 | 0.91 | 3.5 | 50 | | 310 | | |
| | B-2 | 1$^{st}$ component | co-PP*$^1$ | 130 | 17 | 0.922 | 3.1 | 50 | Half-moon shape (FIG. 3) | 220 | 1.9 | None |
| | | 2$^{nd}$ component | Homo-PP | 159 | 7.8 | 0.91 | 3.5 | 50 | | 320 | | |
| Uncrimping fiber | C-1 | 1$^{st}$ component | Homo-PP | 159 | 7.8 | 0.91 | 3.5 | 50 | Crescent shape (FIG. 2) | 220 | 4.3 | None |
| | | 2$^{nd}$ component | HDPE | 133 | 26 | 0.961 | 5.6 | 50 | | 250 | | |
| | C-2 | 1$^{st}$ component | Homo-PP | 159 | 7.8 | 0.91 | 3.5 | 50 | Sheath-core concentric shape (FIG. 5) | 220 | 4.3 | None |
| | | 2$^{nd}$ component | HDPE | 132 | 16 | 0.955 | 5.2 | 50 | | 250 | | |
| | C-3 | 1$^{st}$ component | Homo-PP | 162 | 16 | 0.91 | 4.9 | 50 | Sheath-core concentric shape (FIG. 5) | 220 | 4.3 | None |
| | | 2$^{nd}$ component | HDPE | 132 | 16 | 0.955 | 5.2 | 50 | | 250 | | |

*$^1$co-PP . . . Ethylene-propylene copolymer having a density of 0.922 g/cm$^3$ (3.5 wt % ethylene component)

TABLE 2

| Fiber type | No. | Fineness dtex | Fiber diameter μm | Unit yarn strength cN/dtex | Number of crimps Crimps/inch | Cut length mm | Heat shrinkage rate % | Fiber dispersibility | Crimp shape |
|---|---|---|---|---|---|---|---|---|---|
| Apparently crimping fiber | A-1 | 6.0 | 28.6 | 2.07 | 6.8 | 10 | 4 | ○ | Ohm shape |
| | A-2 | 5.9 | 28.3 | 2.79 | 14.5 | 5 | 2 | ○ | Ohm shape |
| | A-2' | 5.9 | 28.3 | 2.79 | 14.5 | 10 | 2 | X | Ohm shape |
| | A-3 | 3.4 | 21.5 | 2.27 | 7.1 | 10 | 4 | ○ | Ohm shape |
| Latently crimping fiber | B-1 | 3.4 | 21.9 | 2.98 | None | 15 | 75 | ○ | Spiral shape at the time of heat shrinkage |
| | B-2 | 3.3 | 21.5 | 2.67 | 10.3 | 10 | 41 | Δ | Spiral shape at the time of heat shrinkage |
| Uncrimping fiber | C-1 | 3.7 | 22.4 | 2.64 | None | 15 | 30 | ○ | Loose spiral shape |
| | C-2 | 6.7 | 30.2 | 2.11 | None | 15 | 2 | ○ | Straight shape |
| | C-3 | 8.7 | 34.4 | 1.23 | None | 15 | 4 | ○ | Straight shape |

The fiber (A), fiber (B) and/or generally obtained fiber (C) that are obtained as described above were mixed to produce a paper by means of the wet paper-making method at the ratio described in Examples 1 to 6 and Comparative examples 1 to 4 shown in Tables 3 and 4, whereby a web was obtained and formed into a non-woven fabric to produce a paper under each of heat processing conditions. In order to evaluate bulkiness of the obtained paper, the thickness thereof was measured according to JIS-K-6767 at a pressure 2 g/cm$^2$ by means of a digital thickness tester manufactured by Toyo Seiki Seisaku-sho Ltd., and the specific volume was calculated from the following equation.

$$\text{Specific volume (cm}^3\text{/g)} = \text{Thickness (mm)} \times 1000 / \text{Mass per unit area (g/m}^2\text{)}$$

The results of thus obtained each paper are shown in Tables 3 and 4.

TABLE 3

| | | Example 1 | Example 2 | Example 3 | Example 4 | Example 5 | Example 6 |
|---|---|---|---|---|---|---|---|
| Apparently crimping fiber | A-1 | 43.8% | | | | 43.8% | 100% |
| | A-2 | | 43.8% | | | | |
| | A-3 | | | 43.8% | 43.8% | | |
| Latently crimping fiber | B-1 | 56.3% | 56.3% | 56.3% | 56.3% | | |
| | B-2 | | | | | 56.3% | |
| Uniformity | | ○ | ○ | ○ | ○ | Δ | Δ |
| Mass per unit area | g/m$^2$ | 69 | 73.4 | 71.9 | 70.9 | 68.5 | 83 |
| Thickness | mm | 1.16 | 1.349 | 1.176 | 0.972 | 1.099 | 1.37 |
| Specific volume | cm$^3$/g | 16.8 | 18.4 | 16.4 | 13.7 | 16.0 | 16.5 |

TABLE 3-continued

| | | Example 1 | Example 2 | Example 3 | Example 4 | Example 5 | Example 6 |
|---|---|---|---|---|---|---|---|
| Non-woven fabric strength | N/5 cm | 54.1 | 50.5 | 67.7 | 95.4 | 61.5 | 193.5 |

TABLE 4

| | | Comparative Example 1 | Comparative Example 2 | Comparative Example 3 | Comparative Example 4 | Comparative Example 5 |
|---|---|---|---|---|---|---|
| Latently crimping fiber | B-1 | | | | 57.5% | 56.3% |
| Uncrimping fiber | C-1 | 57.5% | 57.5% | 57.5% | | 43.8% |
| | C-2 | 42.5% | 42.5% | | 42.5% | |
| | C-3 | | | 42.5% | | |
| Uniformity | | ○ | ○ | ○ | ○ | ○ |
| Mass per unit area | $g/m^2$ | 70.4 | 68.6 | 67.3 | 76.2 | 82.4 |
| Thickness | mm | 0.788 | 0.945 | 0.671 | 0.785 | 1.008 |
| Specific volume | $cm^3/g$ | 11.2 | 13.8 | 10.0 | 10.3 | 12.2 |
| Non-woven fabric strength | N/5 cm | 103.9 | 34.1 | 127.2 | 152.1 | 54.1 |

Operation and results in each example are described hereinafter.

Example 1

The fiber (A-1) and the fiber (B-1) were dispersed uniformly in water to create a web using a cylinder paper machine, and this web was dehydrated, subjected to a drying process, and thermally adhered at 130° C. using a suction through-air machine to obtain a target paper. The dispersibility of the fibers of the web was good, and the heat shrinkage was produced uniformly. Moreover, the specific volume of the obtained paper was 16.8 $cm^3/g$, which indicates that the paper is bulky, and the paper strength was as high as 54.1 N/5 cm.

Example 2

The fiber (A-2) and the fiber (B-1) were dispersed uniformly in water to create a web using a cylinder paper machine, and this web was dehydrated, subjected to a drying process, and thermally adhered at 130° C. using a suction through-air machine to obtain a target paper. The dispersibility of the fibers of the web was good, and the heat shrinkage was produced uniformly. Moreover, the specific volume of the obtained paper was 18.4 $cm^3/g$, which indicates that the paper is extremely bulky, and the paper strength was as high as 50.5 N/5 cm.

Example 3

The fiber (A-3) and the fiber (B-1) were dispersed uniformly in water to create a web using a cylinder paper machine, and this web was dehydrated, subjected to a drying process, and thermally adhered at 130° C. using a suction through-air machine to obtain a target paper. The dispersibility of the fibers of the web was good, and the heat shrinkage was produced uniformly. Moreover, the specific volume of the obtained paper was 16.4 $cm^3/g$, which indicates that the paper is bulky, and the paper strength was as high as 67.7 N/5 cm.

Example 4

The fiber (A-3) and the fiber (B-1) were dispersed uniformly in water to create a web using a cylinder paper machine, and this web was dehydrated, subjected to a drying process, and thermally adhered at 130° C. using a suction through-air machine under the conditions of wind speed higher than the conditions of the speed of the hot air used in Example 3, to obtain a target paper. The dispersibility of the fibers of the web was good, and the heat shrinkage was produced uniformly. The obtained paper produced an extremely high paper strength of 95.4 N/5 cm while keeping a specific volume of 13.7 $cm^3/g$, which indicates that the paper is bulky. It is considered that the bulkiness was reduced compared to Example 3 due to the enhanced thermal adhesion between the fibers.

Example 5

The fiber (A-1) and the fiber (B-2) were dispersed uniformly in water to create a web using a cylinder paper machine, and this web was dehydrated, subjected to a drying process, and thermally adhered at 130° C. using a suction through-air machine to obtain a target paper. The dispersibility of the fibers of the web was good, and the heat shrinkage was produced uniformly, but fluffing was observed on the paper surface. Moreover, the specific volume of the obtained paper was 16.0 $cm^3/g$, which indicates that the paper is bulky, and the paper strength was as high as 61.5 N/5 cm. Since an apparent crimp is added to the fiber (B-2) having a latent crimp, bulkiness of the fiber was compensated by the added apparent crimp although the strength of the latent crimp was reduced. The reason that fluffing was observed on the surface is considered because the both constituent fibers have spiral three-dimensional crimps and the probability that the fusion components of the respective fibers (low-melting point component) come into contact with each other was reduced, whereby the number of intersections between the fibers was reduced.

Example 6

The fiber (A-1) was dispersed uniformly in water to create a web using a cylinder paper machine, and this web was dehydrated, subjected to a drying process, and thermally adhered at 130° C. using a suction through-air machine to obtain a target paper. The dispersibility of the fiber of the web was good, but the spreading property of a part of the fiber was poor. Moreover, the effects of heat shrinkage of the latently crimping fiber (B) were not observed in the obtained fiber, but the specific volume was 16.5 $cm^3/g$, which indicates that the paper is bulky, and the paper strength was as high as 193.5 N/5 cm.

Comparative Example 1

The fiber (C-1) and the fiber (C-2) were dispersed uniformly in water to create a web using a cylinder paper machine, and this web was dehydrated, subjected to a drying process, and thermally adhered at 135° C. using a suction through-air machine to obtain a target paper. The dispersibility of the fibers of the web was good, and the heat shrinkage was produced uniformly. However, although the strength of the obtained was as high as 103.9 N/5 cm, the specific volume was as low as 11.2 $cm^3/g$, thus target bulkiness was not obtained.

Comparative Example 2

The fiber (C-1) and the fiber (C-2) were dispersed uniformly in water to create a web using a cylinder paper machine. This web was dehydrated, subjected to a drying process, and thermally adhered at 125° C. using a suction through-air machine in order to moderate reduction of bulkiness obtained by thermal adhesion. No problem was observed in the dispersibility of the fibers of the obtained web. Moreover, the specific volume of the paper was 13.8 $cm^3/g$ and thereby target bulkiness was obtained, but the strength was as low as 34.1 N/5 cm, thus the web was temporarily adhered.

Comparative Example 3

The fiber (C-1) and the fiber (C-3) were dispersed uniformly in water to create a web using a cylinder paper machine. This web was dehydrated, subjected to a drying process, and thermally adhered at 130° C. using a suction through-air machine. No problem was observed in the dispersibility of the fibers of the obtained web. However, the specific volume of the paper was as low as 10.0 $cm^3/g$, and the thickened fineness of the fiber did not bring bulkiness for the paper, but resulting in reducing the bulkiness. It is considered that the effects of thickening the fineness of the fiber produce bulkiness effects in a fiber having apparent crimps because the crimping rigidity thereof is improved and thereby the rigidity increases in the thickness direction, but in a fiber of thickened fineness having no crimps, the number of constituent fibers is reduced and the density of filling fibers in the thickness direction is lowered, thus this fiber is vulnerable to the pressure in the thickness direction, whereby the bulkiness is reduced during the treatment step.

Comparative Example 4

The fiber (B-1) and the fiber (C-2) were dispersed uniformly in water to create a web using a cylinder paper machine, and this web was dehydrated, subjected to a drying process, and thermally adhered at 140° C. using a suction through-air machine to obtain a target paper. The dispersibility of the fibers of the web was good, and the heat shrinkage was produced uniformly. However, the specific volume of the obtained paper was 10.3 $cm^3/g$, thus intended significant bulkiness was not obtained. Since the general fiber (C-2) does not have three-dimensional crimps in a spiral or other form, it was confirmed that the paper was sufficiently strong but the bulkiness effects were not obtained even if this fiber was combined with the fiber (B).

Comparative Example 5

The fiber (B-1) and the fiber (C-1) were dispersed uniformly in water to create a web using a cylinder paper machine, and this web was dehydrated, subjected to a drying process, and thermally adhered at 130° C. using a suction through-air machine to obtain a target paper. The dispersibility of the fibers of the web was good, and the heat shrinkage was produced uniformly. However, the specific volume of the obtained paper was 12.2 $cm^3/g$, thus intended significant bulkiness was not obtained. By combining the general fiber (C-1) having spiral crimping with the fiber (B), a certain level of effect was observed but sufficient bulkiness effects were not obtained.

EXPLANATION OF REFERENCE NUMERALS IN DRAWINGS

1 First component configuring eccentric sheath-core type conjugate fiber
2 Second component configuring eccentric sheath-core type conjugate fiber
3 First component configuring side-by-side type conjugate fiber
4 Second component configuring side-by-side type conjugate fiber
5 First component configuring conjugate fiber
6 Second component configuring conjugate fiber

The invention claimed is:

1. A process for preparing a wetlaid non-woven fabric, comprising:

dispersing a mixture of fibers in water and subjecting the dispersed mixture of the fibers to a wet paper-making process so as to obtain a web, and subjecting the obtained web to a heat treatment adhesion so as to obtain the wetlaid non-woven fabric, wherein the mixture of the fibers comprises:

30 wt % or more of a fiber with apparent crimps having a fiber diameter in a range from 3 to 40 μm; and more than 0 wt % and 70 wt % or less of a latently crimping fiber having a fiber diameter in a range from 3 to 40 μm, wherein the fiber with apparent crimps is a synthetic fiber configured from a thermoplastic resin having a crimp number in a range from 5 to 25 crimps/inch, and at least one of zigzag, spiral, and ohmic crimp shapes is provided continuously in a length direction, and a fiber length of the fiber with apparent crimps is in a range from 3 to 15 mm, wherein the wetlaid non-woven fabric has a specific volume of at least 13 $cm^3/g$ and a non-woven fabric strength of 50.5 N/5 cm or more, wherein the fiber with apparent crimps includes a low-melting point resin and a high-melting point resin, wherein the difference in melting points between the low-melting point resin and the high-melting point resin is at least 10° C., wherein the high-melting point resin is crystalline polypropylene resin having a melting point of at least 158° C., wherein said subjecting the obtained web to the heat treatment adhesion comprises performing a heat treatment so that latent crimps of the latently crimping fiber are developed, and wherein the latently crimping fiber has a heat shrinkage rate of a least 30%, wherein the heat shrinkage rate is determined by a method comprising steps of: creating a 25×25 cm web having a mass per unit area of 80 g/m$^2$ from the latently crimping fiber; drying the web for five minutes at 145° C.; measuring a length of a side of the heat-processed web; and calculating the heat shrinkage rate using the following equation:

$$\text{Heat shrinkage rate (\%)}=(1-a/25)\times 100,$$

where a is the length of the side of the heat processed web.

2. The process according to claim 1, wherein the latently crimping fiber is a conjugate fiber in a form of a combination of a first component and a second component, wherein the second component is polyethylene, wherein a melting point of the second component is lower than a melting point of the first component by at least 5° C., and wherein the subjecting the obtained web comprises performing the heat treatment adhesion at a temperature of equal to or lower than the melting point of the first component and equal to or higher than the melting point of the second component.

3. The process according to claim 1, wherein the latently crimping fiber has 10 or less crimps/inch before said subjecting the obtained web to the heat treatment adhesion.

4. The process according to claim 1, wherein the latently crimping fiber is a conjugate fiber that has as a first component, a propylene copolymer having a melting point Tm (° C.) of 110≤Tm≤147 and obtained by copolymerizing one or more α-olefin other than propylene, which is a main constituent, and wherein a form of a combination of the first component and a second component is such that an area ratio between the first component and the second component in a fiber cross-section is in a range from 65/35 to 35/65.

5. The process according to claim 4, wherein the second component of the latently crimping fiber is polypropylene having a melting point of 158° C. or higher.

6. The process according to claim 4, wherein the second component of the latently crimping fiber is polyethylene.

* * * * *